US009216309B1

(12) United States Patent
Filipczak

(10) Patent No.: US 9,216,309 B1
(45) Date of Patent: Dec. 22, 2015

(54) ADIABATIC EXPANSION NOZZLE DESIGN CRITERIA

(71) Applicant: Robert Anthony Filipczak, Linwood, NJ (US)

(72) Inventor: Robert Anthony Filipczak, Linwood, NJ (US)

( * ) Notice: Subject to any disclaimer, the term of this patent is extended or adjusted under 35 U.S.C. 154(b) by 0 days.

(21) Appl. No.: 13/986,382

(22) Filed: Apr. 26, 2013

(51) Int. Cl.
*A62C 31/02* (2006.01)

(52) U.S. Cl.
CPC ..... *A62C 31/02* (2013.01)

(58) Field of Classification Search
CPC ..... F25J 3/02; A62C 31/02
USPC ..... 62/603, 51.2, 910; 239/14.2, 423, 589, 239/590, 590.54
See application file for complete search history.

(56) References Cited

U.S. PATENT DOCUMENTS 6,116,049 A * 9/2000 Filipczak ..... 62/603

* cited by examiner

*Primary Examiner* — Justin Jonaitis

(57) ABSTRACT

Design criteria are presented for an adiabatic expansion nozzle that overcomes previous deficiencies. The original patent demonstrated that dry ice could be produced, but the device clogged, was prone to fracture, and not optimized for any specific application Calculations are presented for a single application, the hand-held, 5-pound, carbon dioxide fire extinguisher. Design considerations for other fire sizes and firefighting applications are also presented.

7 Claims, 2 Drawing Sheets

| Tubing Size (in.) | Area (sq. in.) | Expansion Factor | Tube Offsets (in.) |
|---|---|---|---|
| $T_1$ = 3/16 Inlet tube | $A_1$ = 0.0192 | | $H_1$ = 1/4 |
| $T_2$ = 17/32 | $A_2$ = 0.196 | $F_1$ = 10.2X | $H_2$ = 0.199 Approx.=0.2-in. |
| $T_3$ = 7/8 | $A_3$ = 0.3126 | $F_2$ = 1.76X | $H_3$ = 0.283 Approx 0.3-in. |
| $T_4$ = 1 3/8 | $A_4$ = 0.778 | $F_3$ = 1.59X | $H_4$ = 0.354 Approx. 3/8-in. |
| $T_5$ = 2 | $A_5$ = 1.502 | $F_4$ = 2.49X | $H_5$ = 0.466 Approx. 1/2-in. |
| $T_6$ = 2 3/4 ID Discharge Horn | $A_6$ = 2.798<br>$A_7$ = 5.940 | $F_5$ = 1.86X<br>$F_6$ = 2.12X | |

ADIABATIC EXPANSION NOZZLE DESIGN CRITERIA

CROSS REFERENCE TO RELATED APPLICATIONS

U.S. Pat. No. 6,116,049

STATEMENT OF FEDERALLY SPONSORED RESEARCH/DEVELOPMENT

None

PARTIES TO A JOINT AGREEMENT

None

SEQUENCE LISTING

None

BACKGROUND

The adiabatic expansion nozzle (U.S. Pat. No. 6,116,049 issued Sep. 12, 2000 to DOT, inventor Robert Filipczak) demonstrated superior firefighting ability. Later designs, submitted after the patent was issued found that a replacement nozzle could be made for the ordinary discharge horn on a hand-held, 5-pound carbon dioxide fire extinguisher. Off-the-shelf fire extinguishers made by several companies were retrofitted with a suitably sized adiabatic expansion nozzle, by unscrewing the ⅛ NPT thread on the existing discharge horn and screwing in the adiabatic expansion nozzle. The nozzle worked well but was not very robust. Solder joints failed in some versions of the nozzle and residual dry ice developed inside and could lead to clogging. While the US Government tried to license the idea to private companies, none were willing to take on what was, in essence, a research project or go through the licensing procedure. The fluorocarbon (HFC-23) version worked in the FAA hidden fire scenario, but was not considered a viable replacement agent because high levels of hydrofluoric acid were produced, dangerous to anyone not wearing a self-contained breathing apparatus (SCUBA). Some of the FAA research efforts are contained in an internal publication, "Development and Performance of an Adiabatic Expansion Nozzle for Improved Fire Extinguishers" DOT/FAA/AR-TN01/60. The project has been dormant since the retirement of the inventor from DOT in 2006. All subsequent research, design, and reduction to practice has not involved DOT support or moneys.

BRIEF SUMMARY OF THE INVENTION

The previous design in U.S. Pat. No. 6,116,049 demonstrated the ability to produce dry ice but was not properly sized nor optimized for hand-held fire extinguisher use. The new design minimizes previously encountered problems and has been made robust and practical. Other potential uses and firefighting applications are discussed.

DETAILED DESCRIPTION OF THE INVENTION

Accordingly, it is the object of this invention is to calculate and execute the designs of adiabatic expansion nozzles to fight a wide array of home, automobile, commercial and military fire scenarios. This is the specific design for the Underwriter's Laboratory 5-B rated, hand-held 5-pound carbon dioxide fire extinguisher, but other applications for the device are also explained. Calculations are presented to describe appropriate tubing diameters and tube offsets for this specific application.

It is a further object to design and produce adiabatic expansion nozzles in various sizes depending on the size of a potential fire The nozzle can be scaled to almost any size, determined only by the flow rate and size of the carbon dioxide containment vessel.

It is a further object to use an adiabatic expansion nozzle for fixed fire systems. Current carbon dioxide systems call for total flood of spaces, which is very hazardous to occupants. Deposition of dry ice stratifies the carbon dioxide, collecting and settling to the floor, minimizing personnel hazards.

It is a further object to use an adiabatic expansion nozzle to inert large capacity fuel tanks and create an internal fire fighting capability for suitably outfitted tanks.

It is a further object to provide a cryogenic cooling device with low output velocity and uniform temperature discharge.

DESCRIPTION OF THE PREFERRED EMBODIMENT

Figure 1:
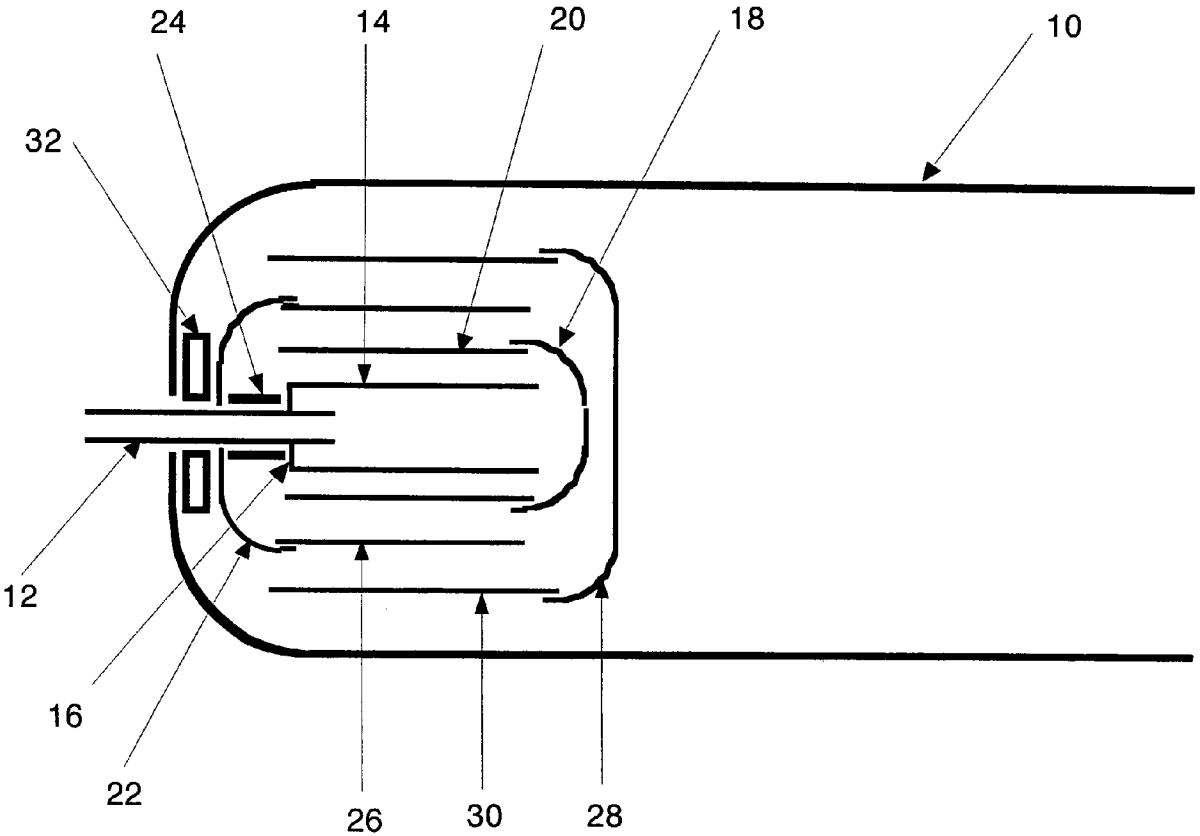
FIG. 1 is a longitudinal cross-section of the improved adiabatic expansion nozzle. Tubing diameters (12, 14, 20, 30), offset distances, and curvature of the end caps (16, 18, 22, 28) have been calculated to maximize dry ice conversion and minimize clogging for a hand-held 5-B rated carbon dioxide fire extinguisher.

As shown in FIG. 1, the adiabatic expansion nozzle is constructed from commercially available materials according to the calculated design parameters for an Underwriter's Laboratory rated 5-B carbon dioxide fire extinguisher. Liquid, room temperature carbon dioxide enters the nozzle through tube 12, then enters tube 14, as it passes end cap 16 allowing the liquid to expand into gas. The flow reverses direction at end cap 18, and enters tube 20. Not shown are spacers that hold 18 and 20 together Flow proceeds along tube 20 until it reaches end cap 22, and reverses direction and enters tube 26. Spacer 24 holds the end caps the proper distance between 16 and 22. Flow proceeds along tube 26, until reversing flow direction at end cap 28 and entering tube 30. Not shown are spacers holding together tubes 26 and 30. Flow leaves the nozzle (brass) and enters the discharge horn 10 (plastic). Spacer 32 holds the adiabatic expansion nozzle the proper distance from the rear of the discharge horn. At this point a dry ice snow exits the discharge horn 10. The flow rate of carbon dioxide is determined the inside diameter (ID) of tube 12.

Figure 2:
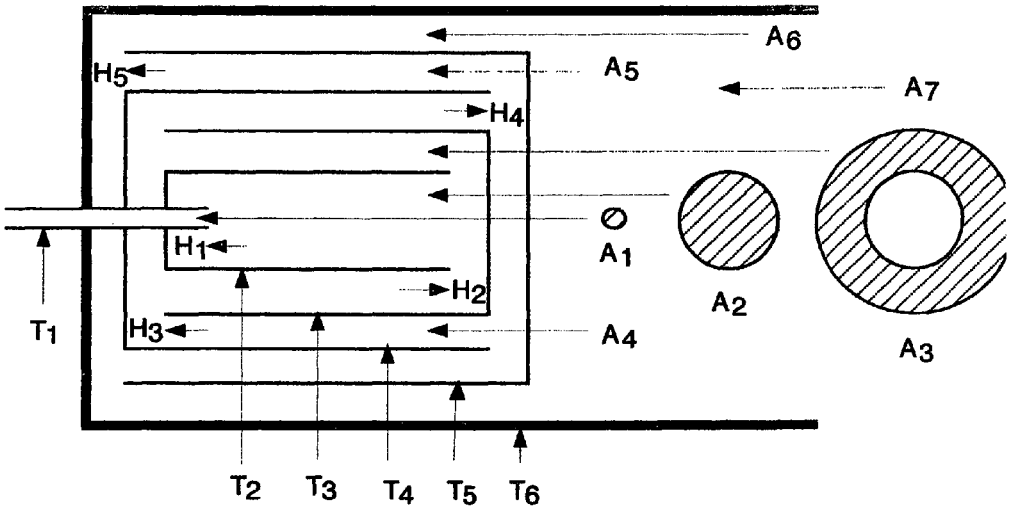
FIG. 2 shows a diagrammatic representation of FIG. 1, also as longitudinal cross-section. for a hand-held 5-B rated carbon dioxide fire extinguisher. Dimensions are given for the various tubings that make up the nozzle, and offsets or the distances from ends of tubings to the end caps that force flow reversal. Areas show the annular areas between tubings as expansions occurs. $A_1$-$A_3$ are illustrated as an end view in cross-hatching, $A_4$-$A_7$ are not shown. Expansion factors are the relative sizes of the areas of expansion as the diameters of the tubings get larger.

FIG. 2 and Table 1 show the tubing size for the desired flow rate to be: $T_1$—3/16-in. o.d.-1/64-in wall. The other tubes dimensions approximate expansion factors of 10× leaving tube 12, with expansion factor of 2× for the remaining tubes. Calculations show desired dimensions to be: $T_2$—17/32-in.-1/64-in. wall, $T_3$—7/8-in.-0.025-in. wall, $T_4$—1 3/8-in-0.025-in wall, $T_5$—2-in.-0.025-in wall, and $T_6$ such that the discharge horn of the fire extinguisher has I.E. of 2 3/4-in. End caps, $E_1$, $E_2$, $E_3$, $E_4$, are constructed to fit tubing sizes snugly, according to design specifications, as are the tubing offsets $H_1$, $H_2$, $H_3$, $H_4$.

Thermodynamics and Calculations

Adiabatic is a term from thermodynamics that means "without the addition or subtraction of heat." At room temperature, $CO_2$ exists as a liquid with a vapor pressure of 830 PSI (pound of pressure per square inch). At room pressure (760 mm Hg), $CO_2$ exists as a gas or as a solid at −79 C. Solid $CO_2$ is also known as "dry ice" and is used to transport frozen foods and other items. The $CO_2$ does not melt, or turn into liquid, but rather sublimes directly to the gas phase: hence the term "dry" ice.

For an adiabatic system, think of that tank of liquid $CO_2$ as being in a thermos bottle. No heat is being added or subtracted: if the contents are cold or hot they will remain cold or hot Now, think of that bottle as not having a lid, but an airtight piston holding the pressure of the liquid. If the piston is raised, increasing the volume of the bottle, two things happen. The liquid boils as the volume increases, and the remaining liquid get colder from subtracting the heat of vaporization from the liquid turning to gas. If the piston is lifted until the bottle is at room pressure, the contents of the bottle are now gaseous and solid $CO_2$, with no liquid remaining. If weights are applied to the piston until the pressure is again 830 PSI, the gas will increase in temperature, the dry ice will melt, and at the end of the cycle the $CO_2$ will be liquid at room temperature. Remove work, the volume expands and the temperature drops $\Delta W = -\Delta Q$. Add work (subtract it from the environment), the volume shrinks and the temperature increases.

The adiabatic nozzle simulates this, in that liquid $CO_2$ is allowed to expand in a very small volume while the flow is reversing direction. The discharge from the nozzle is a low-pressure dry ice snow. True adiabatic process are reversible, however. Here the $CO_2$ cannot be put back in the bottle as liquid. As shown in the Technical Note, theoretical conversion efficiency from liquid to solid is 31% but this would be with a near zero discharge pressure.

The problem in the initial nozzle design is twofold. The distances between end caps 22 and 34 and between end caps 18 and 26 are not specified. This leads to accumulation of dry ice inside the nozzle and can cause clogging. Also, the tubing diameters were selected based on what was easily available, not what might work best. The prototype in the issued patent proved that dry ice snow could be formed continuously, but there was no real attempt at optimizing a hand-held fire extinguisher.

Experiments showed that turbulence in not desirable. Coiling the inlet tube $T_1$ reduced conversion efficiency. Solid $CO_2$ would build up in any dead areas that allow flow stagnation near the end caps. Any areas where flow would constrict, rather than expand, reduced efficiency. The new design eliminates or reduces these problems.

Liquid $CO_2$ reaches the nozzle and flow through the nozzle is controlled by the diameter of the inlet tube $T_1$. The area expansions for the design are 10× from $T_1$ into $T_2$ with subsequent expansion to be 2×, for the hand-held extinguisher.

If the nozzle is used as a stationary system, for example in a galley situation or above machine equipment, throw distance is not i important so the expansion ratios can be increased to convert more of the liquid into dry ice. Fuel storage tanks can be suppressed from inside the tank. Dry ice floats on fuel or solvents, breaking the fuel air boundary, and extinguishing a fire.

A 5-pound (Underwriter's Lab 5-B rated) carbon dioxide extinguisher has a minimum discharge time of 8 seconds. 3/16 in. 0.016 wall brass tubing was found to have the required flow rate. The needed tubing diameters can be calculated based on the outside diameter (OD), the tubing wall thickness, and the desired degree of expansion. Using expansion factors of approximately 10×, 2×, 2×, 2×, and 2× the dimensions are calculated. Telescoping brass tubing is commonly available through hobby shops from 1/16-in to 3/4-in 1/32-in. increments, with approximately/64 (0.016-in.) wall thickness.

The area of a circle is $A=\pi r^2$, where A is the area and r, the radius of the circle. The circumference of a circle is $L=2\pi r$, where r is the radius. The area of a cylinder is A=Lh where L is the circumference multiplied by height, h.

If the inlet is 3/16-in tubing, the inside diameter is 5/32-in and the area $A=\pi(15/64)^2$ $A=0.0192$ in$^2$ To have a 10× expansion the area, the second tube is $0.192=\pi(r^2)$ and r=0.247. The inside diameter of the tube is 0.494 in. so 17/32 tubing is used for the first expansion.

To have the annular space between the second and third tubes equal to twice the area of the second tube, where r is the respective radii of T2 and T3:

$$A_3=2A_2=2(0.192)=0.384 \text{ in}^2$$

$$\pi(r^2_{T3})-\pi(r^2_{T2})=0.384$$

$$\pi(r^2_{T3})=0.384+0.192=0.576$$

$r^2_{T3}=0.576$ rT3=0.428 or the tube diameter for T3=0.865 in. is rounded off to 7/8 in.

$A_4$, $A_5$, and $A_6$ are calculated in the same manner. The remaining tubes are determined to be 1 3/8 in., and 2 in. The ID of the discharge horn into which the nozzle is situated should be 2 3/4 in. This maintains the same carbon dioxide discharge rate as existing 5-B rated fire extinguisher and the same discharge horn dimensions.

Since the area of the cylinder between tubes at flow reversal is equal to the area of the inner tube, $\pi r^2=2\pi rh$ h=½ r. Because the annual space between tube is twice the area of the inside tube the distance from the end cap to the tube can be equal to the radius of the inner tube, which allows the 2× expansion at the point of flow reversal. The distance between T2 and the end cap on T3=1/4 in. Less than that distance would lead to contraction, instead of expansion. More than that invites deposition of solid on the end cap.

Also of importance is to remove the eddy at flow reversal that occurs in the original design at the squared ends of the cylindrical shape, or dry ice will build up. Since the distance between tube and end cap is equal to radius, the rounding should be a dimension between the diameter, 2r, and r the radius of the outer tube.

The tubing sizes calculated for this application which are commercially available were: $T_1$=5/16"-1/64" wall, $T_2$=17/32"-1/64" wall, $T_3$=7/8"-0.025" wall, $T_4$=1 3/8"-0.025" wall, T5=2"-0.025"-wall and $T_6$ the inside diameter (ID) of the discharge horn to be 2 3/4".

The radius of the curve of the end caps was selected to be a uniform 3/8-in. to minimize tooling cost for the end cap stampings. Height, H, is measured from the inner tube to the curved portion of the end cap, E. 3/8-in. is larger than all of the annular distances between tubes, and H is measured to the intersection point with the inner tube and curved portion of the end cap. The radius of curvature of the end cap should be ne less that the distance between tubes.

FIG. 2 shows diagrammatically the tube sizes, respective areas, expansion factors, and tube offsets listed in Table 1 as T, A, F, H. The total expansion factor for the hand-held application is 280×. For other applications the throw distance may not be needed or desirable. Larger expansion factors will reduce the velocity of the discharge but increase the conversion efficiency to dry ice. This may be useful for fixed fire-fighting systems. Tapering the end of the discharge horn will allow a more focused and forceful discharge, with increased throw distance. Expanding the end will disperse discharge to a wider area.

The discharge horn 10 is represented as a round tube, curved at the end where it meets inlet tube 12. Depending on the application, the outlet could focus in, expand out, or use vanes as in the original patent (U.S. Pat. No. 6,116,049) to direct solid flow but not inhibit expansion. Depending on the application, the outlet can be square or rectangular to accommodate specific areas protected by fixed systems. The discharge horn represented in FIG. 1 is a straight tube.

I claim:

1. An optimized adiabatic expansion nozzle which comprises an inlet tube for receiving a liquid, a primary expansion tube surrounding said inlet tube in which said liquid expands in said primary expansion tube at a primary expansion ratio, a primary end cap at an end of said primary expansion tube opposite to said inlet tube, said primary end cap reversing flow direction of said expanded liquid into an adjacent one or more secondary expansion tubes, said liquid expands in said one or more secondary expansion tubes at a second expansion ratio, and secondary end caps positioned at an outlet end of each of said one or more secondary expansion tubes for reversing flow direction of said expanded liquid to flow over the outside of an adjacent one of said one or more said secondary end tubes, wherein said primary end cap and said secondary end cap have a curved shape with a rounding between a diameter 2r and a radius r of an outer one of said one or more secondary expansion tubes.

2. The nozzle of claim 1 wherein a radius of curvature of the primary end cap and the one or more secondary end caps is no less than a distance between an adjacent secondary expansion tube.

3. The nozzle of claim 1 wherein said primary expansion ratio is greater than said second expansion ratio of said one or more secondary expansion tubes.

4. The nozzle of claim 3 wherein said second expansion ratio is uniform for each of said one or more secondary expansion tubes.

5. The nozzle of claim 4 wherein said primary expansion ratio is 10× and said second expansion ratio is 2×.

6. The nozzle of claim 5 having a throw distance suitable for a hand held fire extinguisher application and the inlet tube provides a discharge time of over 8 seconds for 5 pounds of carbon dioxide.

7. The nozzle of claim 1 further comprising a discharge horn surrounding said primary expansion tube and said one or more secondary expansion tubes, said discharge horn having a tapered shape.

* * * * *